US006880353B1

(12) United States Patent
Yap et al.

(10) Patent No.: US 6,880,353 B1
(45) Date of Patent: Apr. 19, 2005

(54) VAPOR COMPRESSION SYSTEM WITH EVAPORATOR DEFROST SYSTEM

(75) Inventors: Zer Kai Yap, Tecumseh, MI (US); James L. Douglas, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/887,183

(22) Filed: Jul. 8, 2004

(51) Int. Cl.[7] ..... F25B 47/00
(52) U.S. Cl. ..... 62/277; 62/278
(58) Field of Search ..... 62/197, 204, 277, 62/278, 513

(56) References Cited

U.S. PATENT DOCUMENTS

| | | | | |
|---|---|---|---|---|
| 4,566,288 A | * | 1/1986 | O'Neal | 62/196.1 |
| 4,862,702 A | * | 9/1989 | O'Neal | 62/196.4 |
| 5,090,209 A | | 2/1992 | Martin | |
| 5,205,347 A | | 4/1993 | Hughes | |
| 5,454,228 A | * | 10/1995 | Yang et al. | 62/113 |
| 5,611,214 A | | 3/1997 | Wegeng et al. | |
| 5,622,219 A | | 4/1997 | Voss et al. | |
| 5,811,062 A | | 9/1998 | Wegeng et al. | |
| 6,126,723 A | | 10/2000 | Drost et al. | |
| 6,148,635 A | | 11/2000 | Beebe et al. | |
| 6,311,507 B1 | | 11/2001 | Gameiro | |
| 6,434,955 B1 | | 8/2002 | Ng et al. | |
| 6,550,270 B1 | | 4/2003 | Rudick | |
| 6,622,519 B1 | | 9/2003 | Mathias et al. | |
| 6,630,012 B1 | | 10/2003 | Wegeng et al. | |
| 2003/0140638 A1 | | 7/2003 | Arshansky et al. | |

FOREIGN PATENT DOCUMENTS

| | | |
|---|---|---|
| JP | 2002107069 A | 4/2002 |
| JP | 2002243350 A | 8/2002 |

* cited by examiner

*Primary Examiner*—Melvin Jones
(74) *Attorney, Agent, or Firm*—Baker & Daniels

(57) ABSTRACT

A vapor compression system including a refrigerant circuit having operably coupled thereto, in serial order, a compressor, a first heat exchanger, an expansion device, and a second heat exchanger. A valve is disposed within refrigerant circuit between first heat exchanger and expansion device, and has a first position and a second position. A defrost circuit having operably coupled thereto a third heat exchanger defines an inlet in fluid communication with refrigerant circuit through valve when valve is in second position, and an outlet disposed in refrigerant circuit between inlet and expansion device. A check valve is disposed in defrost circuit between third heat exchanger and outlet. The check valve allows refrigerant to return to refrigerant circuit through outlet and prevents refrigerant from entering third heat exchanger via outlet. The refrigerant flows through third heat exchanger and second heat exchanger when valve is in second position.

16 Claims, 2 Drawing Sheets

VAPOR COMPRESSION SYSTEM WITH EVAPORATOR DEFROST SYSTEM

BACKGROUND OF THE INVENTION

1. Field of the Invention

The present invention relates to vapor compression systems, particularly, vapor compression systems having an evaporator defrost system.

2. Description of the Related Art

Conventional vapor compression systems typically include a refrigerant circuit through which a compressible refrigerant flows and which fluidly connects, in serial order, a compressor, a condenser, an expansion valve, and an evaporator. In operation, the condenser transfers thermal energy from the compressed refrigerant flowing therein to the ambient air surrounding the condenser, thereby warming the air and condensing the refrigerant. Meanwhile, the evaporator transfers thermal energy from the ambient air surrounding the evaporator to the compressed refrigerant flowing through the evaporator, thereby cooling the air and evaporating the compressed refrigerant. During this process, condensation may form on the evaporator surface. Under certain conditions, this condensation may freeze thus causing frost to accumulate on the evaporator surface. The accumulation of ice and frost on the evaporator surface may impair the ability of the evaporator to transfer thermal energy, thus resulting in reduced efficiency.

Accordingly, vapor compression systems may be equipped with a defrost system for melting the ice formed on the evaporator. Many such defrost systems provide a mechanism for temporarily blocking the flow of the compressed refrigerant to the evaporator, while directing the flow of a hot refrigerant to the evaporator to thaw or defrost the ice formed on the evaporator surface. Once thawed, the flow of hot refrigerant to the evaporator is ceased and the flow of compressed refrigerant to the evaporator is restored. Unfortunately, such defrost systems interrupt the operation of the compression system and the flow of refrigerant through the circuit, which may result in reduced efficiency and temperature fluctuations. Accordingly, a need remains for a vapor compression system having an effective and efficient defrost system for defrosting the evaporator surface.

SUMMARY OF THE INVENTION

The present invention provides a vapor compression system having an evaporator defrost system. The vapor compression system, in one form, includes a refrigerant circuit having operably coupled thereto, in serial order, a compressor, a first heat exchanger, an expansion device, and a second heat exchanger. During operation of the compression system the refrigerant is compressed to a high pressure in the compressor and is circulated through the refrigerant circuit. Thermal energy is removed from the refrigerant in the first heat exchanger. The pressure of the refrigerant is reduced in the expansion device, and thermal energy is added to the refrigerant in the second heat exchanger. A valve is disposed within the refrigerant circuit between the first heat exchanger and the expansion device. The valve has a first position and a second position. A defrost circuit defines an inlet in fluid communication with the refrigerant circuit through the valve, and an outlet fluidly coupled to the refrigerant circuit at a position between the valve and the expansion valve. A third heat exchanger is disposed in the defrost circuit between the inlet and the outlet, and is in thermal exchange with the second heat exchanger. When the valve is in the first position the refrigerant bypasses the defrost circuit and flows to the expansion valve without passing through the defrost circuit. When the valve is in the second position the refrigerant circulates through the defrost circuit wherein thermal energy is removed from the refrigerant in the third heat exchanger and thermal energy is added to the second heat exchanger. When the valve is in second position the refrigerant flows through both the third heat exchanger and the second heat exchanger.

The vapor compression system, in another form, includes a refrigerant circuit having operably coupled thereto, in serial order, a compressor, a first heat exchanger, an expansion device, and a second heat exchanger. A valve is disposed within the refrigerant circuit between the first heat exchanger and the expansion device, and has a first position and a second position. A defrost circuit is operably coupled to a third heat exchanger and defines an inlet in fluid communication with the refrigerant circuit through the valve when the valve is in the second position, and an outlet disposed in the refrigerant circuit between the inlet and the expansion device. A check valve is disposed in the defrost circuit between the third heat exchanger and the outlet. The check valve allows refrigerant to return to the refrigerant circuit through the outlet and prevents refrigerant from entering the third heat exchanger via the outlet. The refrigerant flows through third heat exchanger and second heat exchanger when valve is in the second position.

The present invention also provides a method for defrosting a heat exchanger of a vapor compression system. The method, in one form, includes the steps of circulating a refrigerant through a refrigerant circuit including, in serial order, a compressor, a first heat exchanger, an expansion device, and a second heat exchanger; detecting the temperature of the refrigerant flowing from the second heat exchanger; and when the temperature falls below a preset level, initiating a defrost cycle, wherein during the defrost cycle a portion of the refrigerant flowing between the compressor and the expansion device is diverted through a defrost circuit to exchange thermal energy with the second heat exchanger and thereby defrost the second heat exchanger, the diverted portion of the refrigerant being returned to the refrigerant circuit at a position between the first heat exchanger and the expansion device wherein refrigerant is continuously circulated through the second heat exchanger during the defrost cycle.

One advantage of the present invention is that the circulation of low pressure compressed refrigerant through the evaporator is not interrupted during the defrost cycle. An additional advantage is that the defrost cycle uses waste heat of the system to defrost the evaporator, therefore maintaining efficiency. Additional advantages will become more apparent by referencing the detailed description below.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 1:
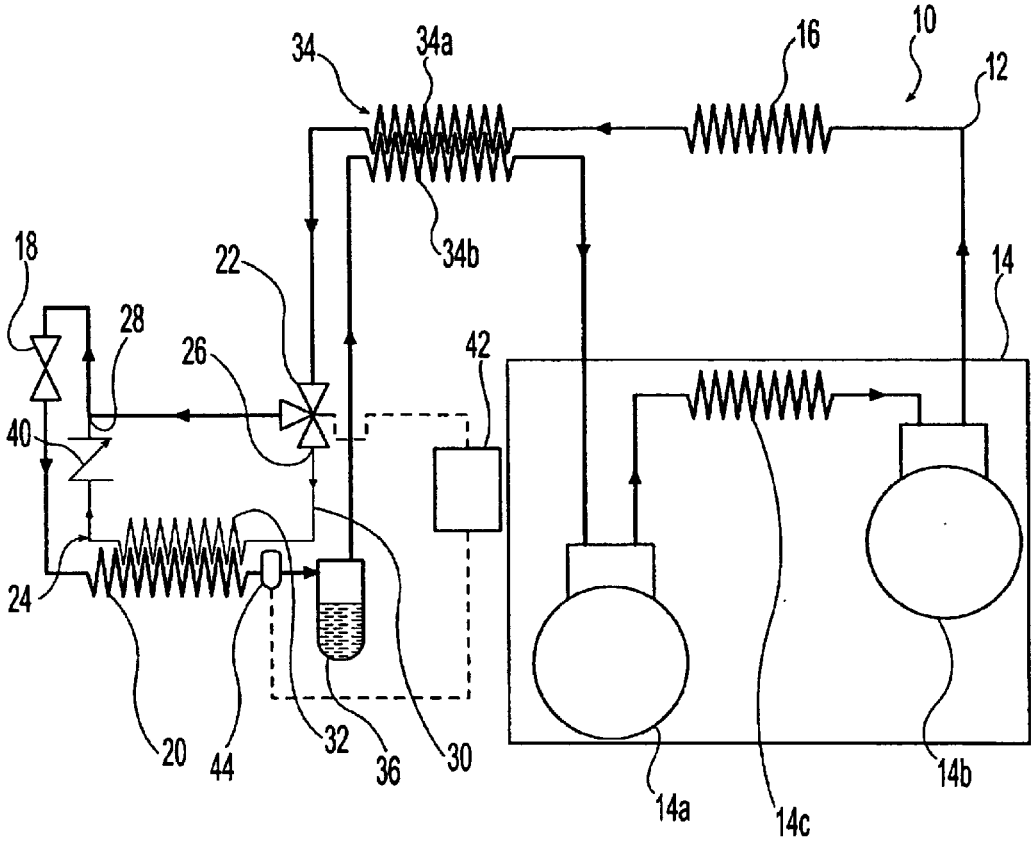
FIG. 1 is a schematic illustration of a vapor compression system according to one embodiment of the present invention, wherein the vapor compression system is in general operating mode.
Figure 2:
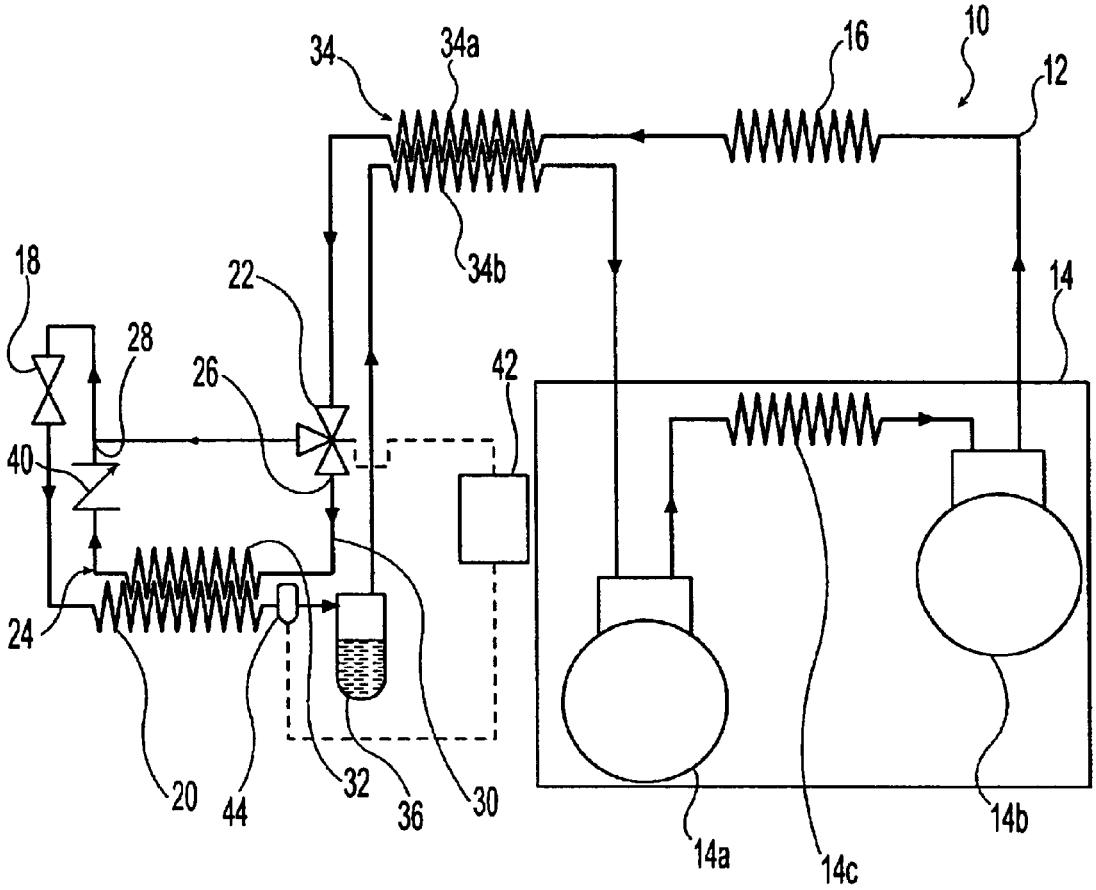
FIG. 2 is a schematic illustration of the vapor compression system of FIG. 1 wherein the vapor compression system is in defrost mode.

Referring first to FIGS. 1 and 2, vapor compression system 10 includes refrigerant circuit 12 (represented by the bold flow lines shown in FIG. 1), through which flows a compressible refrigerant fluid such as carbon dioxide, a hydrocarbon refrigerant (e.g. butane) or other suitable refrigerant. Operably coupled to refrigerant circuit 12, in serial order, is compressor 14, first heat exchanger 16, expansion device 18, second heat exchanger 20 and accumulator 36. A suction line heat exchanger 34 is also operably coupled to fluid circuit 12. Suction line heat exchanger 34 includes a first portion 34*a* operably coupled to refrigerant circuit 12 between first heat exchanger 16 and expansion device 18, and a second portion 34*b* operably coupled to refrigerant circuit 12 between accumulator 36 and compressor 14. First and second portions 34*a*, 34*b* are in a heat exchange relationship with one another.

In general operation the refrigerant circulates along the path illustrated in bold in FIG. 1. More specifically, refrigerant is drawn by suction pressure into compressor 14 where the refrigerant is compressed to a discharge pressure. Compressor 14 is illustrated in FIGS. 1 and 2 as a multi-stage compressor having a low-stage compressor mechanism 14*a*, a high-stage compressor mechanism 14*b* and an intercooler 14*c* disposed in fluid circuit 12 between high-stage mechanism 14*b* and low-stage mechanism 14*a* However, it should be understood that the compressor may be any single-stage or multi-stage compressor capable of compressing a refrigerant, such as carbon dioxide. The refrigerant drawn into compressor 14 first enters low-stage mechanism 14*a* wherein the refrigerant is compressed to an intermediate pressure and high temperature. The intermediate pressure refrigerant then flows through intercooler 14*c* where it is cooled. The cooled intermediate pressure refrigerant then enters high-stage compressor mechanism 14*b* wherein the refrigerant is further compressed to a final discharge pressure and a high temperature.

The resulting high temperature, high pressure refrigerant is discharged from compressor 14 and flows through circuit 12 to first heat exchanger 16. First heat exchanger 16 acts as a condenser wherein thermal energy is removed from the refrigerant, thereby condensing the refrigerant. Although thermal energy is removed from the refrigerant in condenser 16, the refrigerant exiting condenser 16 retains a significant amount of thermal energy and is still at a relatively high temperature. The refrigerant then flows through first portion 34*a* of suction line heat exchanger 34, wherein thermal energy is transferred to the refrigerant flowing in second portion 34*b*. The refrigerant then flows through fluid circuit 12 to expansion device 18 which reduces the pressure of the refrigerant and meters the refrigerant to second heat exchanger 20.

Second heat exchanger 20 acts as an evaporator wherein thermal energy is transferred from the ambient air to the refrigerant, thereby cooling the air surrounding evaporator 20 and evaporating the refrigerant. The refrigerant then flows through fluid circuit 12 to accumulator 36. Accumulator 36 stores any liquid refrigerant remaining in the refrigerant exiting evaporator 20. Accumulator 36 releases the liquid refrigerant at a controlled rate to compressor 14. The vapor refrigerant exiting evaporator 20 flows through accumulator 36 to second portion 34*b* of suction line heat exchanger, wherein the vapor refrigerant receives thermal energy from the refrigerant flowing through first portion 34*a*, thereby warming the refrigerant flowing through second section 34*b*. The warmed refrigerant vapor then flows back to compressor 14 via fluid circuit 12 and the cycle is repeated.

The transfer of heat from the ambient air of evaporator 20 to the refrigerant in evaporator 20 may cause frost to form on the evaporator. To thaw any frost formed on the evaporator, vapor compression system 10 includes defrost circuit 24. Defrost circuit 24 includes defrost line 30 which defines inlet 26 and outlet 28. Inlet 26 is in fluid communication with fluid circuit 12 through valve 22, which is disposed in fluid circuit 12 at a position between first portion 34*a* of suction line heat exchanger 34 and expansion device 18. Valve 22 has a first position and a second position. In the first position, valve 22 directs the flow of refrigerant to expansion device 18 via the fluid circuit 12, as shown in bold in FIG. 1, thereby bypassing defrost line 30. In the second position, valve 22 directs the refrigerant to expansion device 18 via defrost line 30, as illustrated by the bold flow lines in FIG. 2. Valve 22 is depicted in FIGS. 1 and 2 as a three way valve. However, valve 22 may be any valve capable of selectively directing at least a substantial amount of the refrigerant to expansion valve 18 via either defrost circuit 30, as shown in FIG. 2, or refrigerant circuit 12, as shown in FIG. 1. Outlet 28 is fluidly coupled to fluid circuit 12 at a position between valve 22 and expansion device 18.

Figure 3:
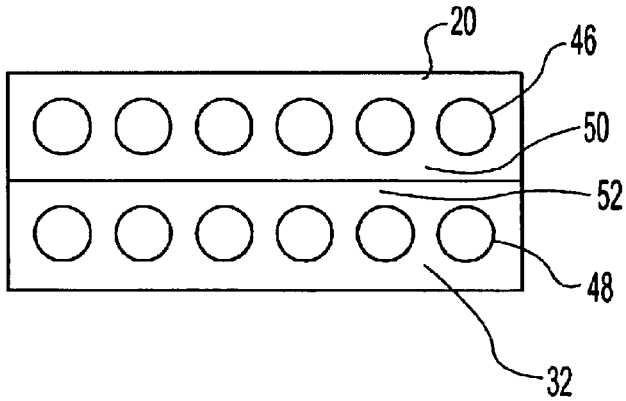
FIG. 3 is a sectional view of an evaporator in thermal relationship with a defroster in accordance with one embodiment of the present invention.

Defrost circuit 24 also includes a third heat exchanger or defroster 32, which is disposed in, and operably coupled to, defrost line 30. Third heat exchanger 32 is in thermal exchange with evaporator 20. FIG. 3 illustrates one configuration of the heat exchange relationship between third heat exchanger 32 and evaporator 20. Third heat exchanger 32 defines microcoils 48 through which the refrigerant flows, and conductive region 52 adjacent microcoils 48. Evaporator 20 also defined microcoils 46 and conductive region 50. Third heat exchanger 32 is positioned adjacent evaporator 20 such that conductive regions 50, 52 are in contact with one another. Conductive regions 50, 52 are formed of a thermally conductive material, such as aluminum, steel, and etc. that are capable of transferring heat between microcoils 46, 48.

Referring back to FIGS. 1 and 2, defrost circuit 24 also includes check valve 40, which is disposed in, and operably coupled to, defrost line 30 between third heat exchanger 32 and outlet 28. Check valve 40 is a one-way valve adapted to permit refrigerant to flow from third heat exchanger 32 to outlet 28, while preventing refrigerant flowing to third heat exchanger 32 from outlet 28. Check valve 40 may be any conventional valve capable of restricting the flow of high pressure refrigerant to one direction.

System 10 also includes sensor 44 which is adapted to detect frost formation on evaporator 20. Sensor 44 can detect frost using any acceptable means. For instance, accumulation of ice on the evaporator may result in inefficient and/or ineffective heat exchange and evaporation. Thus, the temperature of the refrigerant flowing from the evaporator may decrease significantly when ice accumulates on the evaporator. In addition, the pressure of the refrigerant flowing from the evaporator may also decrease due to inefficient evaporation. Accordingly, in FIGS. 1 and 2, sensor 44 is operably coupled to fluid circuit 12 adjacent the outlet of evaporator 20 and is adapted to sense the temperature and/or pressure of the refrigerant flowing from evaporator 20.

However, sensor 44 may be positioned in any position suitable for sensing ice formation on evaporator 20. For instance, in one alternative, sensor 44 may be operably coupled directly to evaporator 20 and may detect the temperature of evaporator 20. In still another alternative, sensor 44 may be coupled to fluid circuit 12 between accumulator 36 and compressor 14.

Controller 42 is operably coupled to sensor 44 and is adapted to receive the temperature and/or pressure sensed by sensor 44. Controller 42 is also operably coupled to valve 22 and is adapted to switch valve 22 between first and second positions.

During general operation of vapor compression system 10, sensor 44 senses the temperature and/or pressure of the refrigerant exiting evaporator 20 and communicates the sensed temperature and/or pressure to controller 42. As noted above, a sensed temperature below a certain level could be an indication of ice formation on evaporator 20. Similarly, a sensed pressure below a certain level may also indicate inefficient and/or ineffective evaporation due to ice formation on evaporator 20. When the sensed temperature and/or pressure falls below a predetermined value, controller 42 initiates a defrost cycle by switching valve 22 from the first position to the second position. During the defrost cycle, the refrigerant circulates through system 10 along the flow path illustrated in bold in FIG. 2. More particularly, the refrigerant flowing from first portion 34*a* of suction line heat exchanger 34 flows to valve 22 where the flow is directed to defrost line 30 through inlet 26. The refrigerant flows through defrost line 30 and enters the coils 48 of third heat exchanger 32. At this point thermal energy is transferred via conduction from the refrigerant in microcoils 48, across first and second conductive regions 50, 52, to microcoils 46 of evaporator 20, thereby melting any ice formed on coils 46 of evaporator 20. The refrigerant then exits third heat exchanger 32 and flows through check valve 40. Check valve 40 prevents the refrigerant from flowing from outlet 28 to third heat exchanger 32. The diverted refrigerant then exits defrost circuit 24 via outlet 28 and reenters fluid circuit 12 where it continues to circulate along the fluid circuit path shown in bold in FIG. 2. As illustrated in FIG. 2, the flow of compressed refrigerant to evaporator 20 is not interrupted during the defrost cycle, thereby maintaining efficiency.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A vapor compression system for use with a carbon dioxide refrigerant, the compression system comprising:

a refrigerant circuit having operably coupled thereto, in serial order, a compressor, a first heat exchanger, an expansion device, and a second heat exchanger, wherein during operation of said compression system the refrigerant is compressed to a high pressure in said compressor and is circulated through said refrigerant circuit, thermal energy being removed from the refrigerant in said first heat exchanger, the pressure of the refrigerant being reduced in said expansion device, and thermal energy being added to the refrigerant in said second heat exchanger;

a valve disposed within said refrigerant circuit between said first heat exchanger and said expansion device, said valve having a first position and a second position;

a defrost circuit defining an inlet and an outlet, said inlet in fluid communication with said refrigerant circuit through said valve, said outlet fluidly coupled to said refrigerant circuit at a position between said valve and said expansion device;

a third heat exchanger disposed in said defrost circuit between said inlet and said outlet, said third heat exchanger in thermal exchange with said second heat exchanger, wherein when said valve is in the first position said refrigerant bypasses said defrost circuit and flows to said expansion device without passing through said defrost circuit, and when said valve is in the second position the refrigerant circulates through said defrost circuit wherein thermal energy is removed from the refrigerant in said third heat exchanger and thermal energy is added to said second heat exchanger and wherein when said valve is in second position the refrigerant flows through both said third heat exchanger and said second heat exchanger.

2. The compression system of claim 1 further comprising a fourth heat exchanger disposed in said refrigerant circuit and providing thermal exchange between a first location in said refrigerant circuit located between said first heat exchanger and said expansion valve and a second location in said refrigerant circuit located between said second heat exchanger and said compressor.

3. The compression system of claim 1 further comprising a check valve disposed in said defrost circuit between said third heat exchanger and said outlet, said check valve configured to communicate refrigerant from said third heat exchanger to said outlet and to prevent refrigerant from flowing from said outlet to said third heat exchanger.

4. The compression system of claim 1 wherein said valve is electronically controlled and said compression system further comprises a controller electronically coupled to said valve and a sensor electronically coupled to said controller, said sensor detecting the temperature of refrigerant flowing from said second heat exchanger and communicating said temperature to said controller, said controller moving said valve from said first position to said second position when said temperature falls below a preset level.

5. The compression system of claim 1 wherein said second heat exchanger comprises a first set of microcoils and said third heat exchanger comprises a second set of microcoils.

6. The compression system of claim 2 wherein an accumulator is operably coupled, said refrigerant circuit between said second heat exchanger and said second location.

7. A vapor compression system for use with a refrigerant, the compression system comprising:

a refrigerant circuit having operably coupled thereto, in serial order, a compressor, a first heat exchanger, an expansion device, and a second heat exchanger;

a valve disposed within said refrigerant circuit between said first heat exchanger and said expansion device, said valve having a first position and a second position;

a defrost circuit having operably coupled thereto a third heat exchanger, said defrost circuit defining an inlet and an outlet, said inlet in fluid communication with said refrigerant circuit through said valve when said valve is in said second position; and a check valve disposed in said defrost circuit between said third heat exchanger and said outlet, said check valve allowing refrigerant to return to the refrigerant circuit through said outlet and preventing refrigerant from entering said third heat exchanger via said outlet, said outlet disposed in the refrigerant circuit between said inlet and said expansion device, wherein the refrigerant flows through third heat exchanger and second heat exchanger when valve is in said second position.

8. The compression system of claim 7 further comprising a sensor, said sensor detecting the temperature of refrigerant flowing from said second heat exchanger, said sensor operably coupled to said valve to move said valve from said first position to said second position when said temperature falls below a preset level.

9. The compression system of claim 7 further comprising a fourth heat exchanger disposed in said refrigerant circuit and providing thermal exchange between the refrigerant flowing from said first heat exchanger and the refrigerant flowing from said second heat exchanger.

10. The compression system of claim 7 wherein said second heat exchanger includes a first set of microcoils and a first conductive region.

11. The compression system of claim 10 wherein said third second heat exchanger includes a second set of microcoils and a second conductive region.

12. The compression system of claim 11 wherein said first and second conductive regions are in thermal communication with one another.

13. A method for defrosting a heat exchanger of a vapor compression system, the method comprising the steps of:

circulating a refrigerant through a refrigerant circuit including, in serial order, a compressor, a first heat exchanger, an expansion device, and a second heat exchanger;

detecting the temperature of the refrigerant flowing from the second heat exchanger; and when the temperature falls below a preset level, initiating a defrost cycle, wherein during the defrost cycle a portion of the refrigerant flowing between the compressor and the expansion device is diverted through a defrost circuit to exchange thermal energy with the second heat exchanger and thereby defrost the second heat exchanger, the diverted portion of the refrigerant being returned to the refrigerant circuit at a position between the first heat exchanger and the expansion device wherein refrigerant is continuously circulated through the second heat exchanger during the defrost cycle.

14. The method of claim 13 wherein said step of detecting the temperature of the refrigerant flowing from the evaporator includes operably coupling a sensor to the refrigerant circuit at a position downstream of the second heat exchanger to detect the temperature of the refrigerant flowing from the second heat exchanger.

15. The method of claim 13 further comprising the step of positioning a one-way valve downstream of the defrost circuit and in communication with the refrigerant circuit such that the one way valve permits the flow of refrigerant from the defrost circuit to the refrigerant circuit and prohibits the flow of refrigerant from the refrigerant circuit to the defrost circuit through the one-way valve.

16. The method of claim 13 wherein the refrigerant is carbon dioxide.

* * * * *